United States Patent [19]

Teichert

[11] 3,953,697

[45] Apr. 27, 1976

[54] DUAL FULCRUM SWITCH

[75] Inventor: Allen L. Teichert, Placentia, Calif.

[73] Assignee: Robertshaw Controls Company, Richmond, Va.

[22] Filed: Nov. 28, 1973

[21] Appl. No.: 419,806

[52] U.S. Cl. ..... 200/243; 200/153 R; 200/DIG. 42

[51] Int. Cl. ..... H01h 1/20

[58] Field of Search..... 200/DIG. 42, 243, 16 A, 200/153 R, 283, 246

[56] References Cited

UNITED STATES PATENTS

| | | | |
|---|---|---|---|
| 2,170,961 | 8/1939 | Borgkuist | 200/243 X |
| 2,384,988 | 9/1945 | Ellis et al. | 200/243 X |
| 3,324,268 | 6/1967 | Adams | 200/283 X |
| 3,340,372 | 9/1967 | Schaefer | 200/DIG. 42 X |
| 3,514,561 | 5/1970 | Ogawa | 200/243 X |

FOREIGN PATENTS OR APPLICATIONS

| | | | |
|---|---|---|---|
| 1,140,261 | 11/1962 | Germany | 200/6 |

*Primary Examiner*—Robert K. Schaefer
*Assistant Examiner*—William J. Smith
*Attorney, Agent, or Firm*—Fulwider, Patton, Rieber, Lee and Utecht

[57] ABSTRACT

A switch including a housing carrying a first contact defining a first fulcrum and having an elongated electrically conductive lever blade disposed in overlying relationship and carrying a second contact from one end thereof for normally engaging such first contact. A third contact is carried from the opposite end of such blade and is movable through a predetermined path to engage a fourth contact carried from the housing and defining a second fulcrum. Biasing means is provided for normally biasing the second and third contacts into engagement with the respective first and fourth contacts. An actuator is operative to overcome such biasing means to disengage the second contact from the first contact and is further operative to, in case the first and second contacts become welded together, sufficiently overcome such biasing means to disengage the third and fourth contacts.

6 Claims, 3 Drawing Figures

DUAL FULCRUM SWITCH

BACKGROUND OF THE INVENTION

1. Field of the Invention

The present invention relates to electrical switches.

2. Description of the Prior Art

It has been common practice to design electrical switches with flexible electrically conductive cantileverally mounted blades carrying contacts from the free ends thereof and flexible to engage such contacts with stationary electrical contacts to complete a circuit through such switch. Such switches suffer the shortcoming that the flexibility requirements of the blades are dictated by the limited forces produced by conventional actuators thus severely restricting the current carrying capabilities of such blades.

Further, switches have been proposed that include relatively stiff blades which are pivoted at one end and carry electrical contacts from the free ends thereof. A switch of this type is shown in U.S. Pat. No. 2,695,939. In the operation of such electrical switches, the contacts thereof frequently become welded together due to arcing between contacts during making and breaking thereof. In such instances, it is desirable to have a safety feature whereby the switch will still open upon actuation thereof to thus assure discontinuance of current to the load being controlled. The switch shown in the above-mentioned patent fails to provide this safety feature.

SUMMARY OF THE INVENTION

The dual fulcrum switch of the present invention is characterized by two pairs of electrical contacts disposed in spaced apart relationship with one contact of each pair being carried from opposite ends of a relatively stiff electrically conductive lever blade which is biased to normally maintain such contacts in their closed position. An actuator is provided for engaging one end of the blade to overcome the bias means and open the first pair of contacts and is further operative, should such first pair of contacts become welded together, to rotate the blade about such first pair of contacts to further overcome such bias means and open the second pair of contacts.

The objects and advantages of the present invention will become apparent from a consideration of the following detailed description when taken in conjunction with the accompanying drawing.

DESCRIPTION OF THE PREFERRED EMBODIMENT

Figure 1:
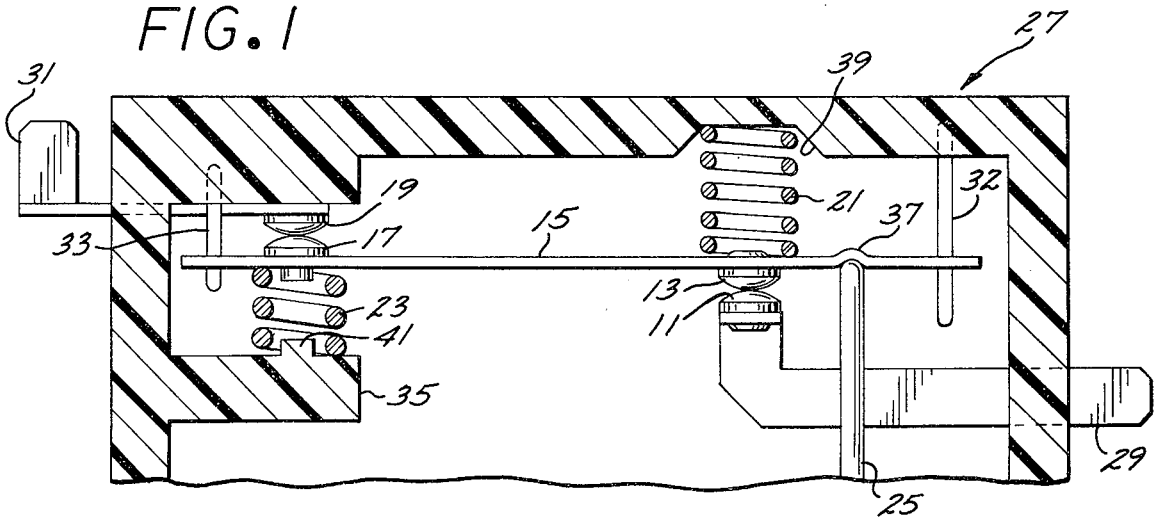
FIG. 1 is a sectional view of a dual fulcrum switch embodying the present invention and depicting both pairs of contacts closed.
Figure 2:
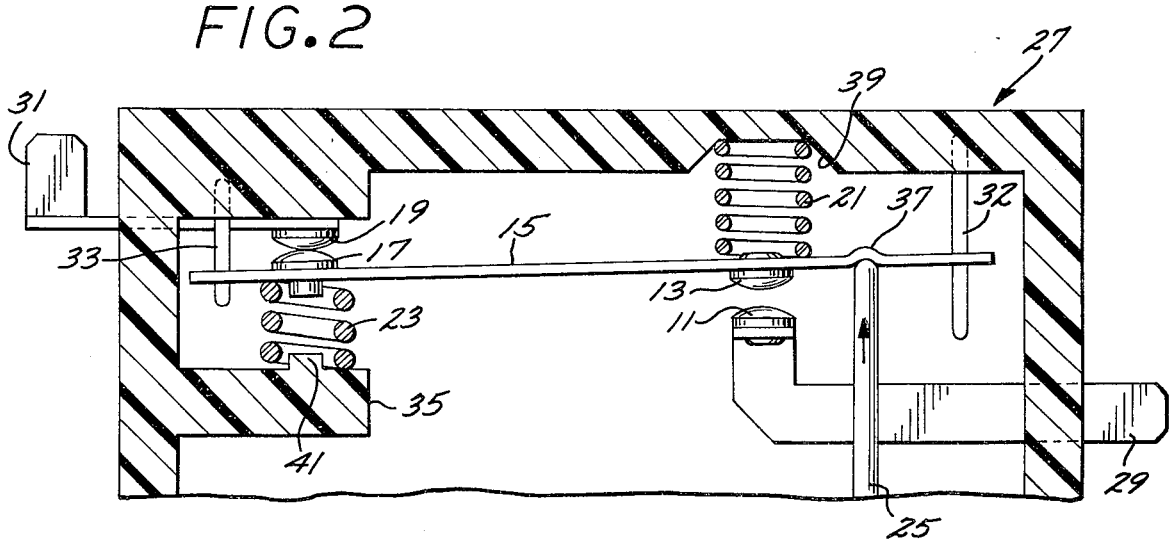
FIG. 2 is a sectional view similar to FIG. 1 but showing one pair of contacts open.
Figure 3:
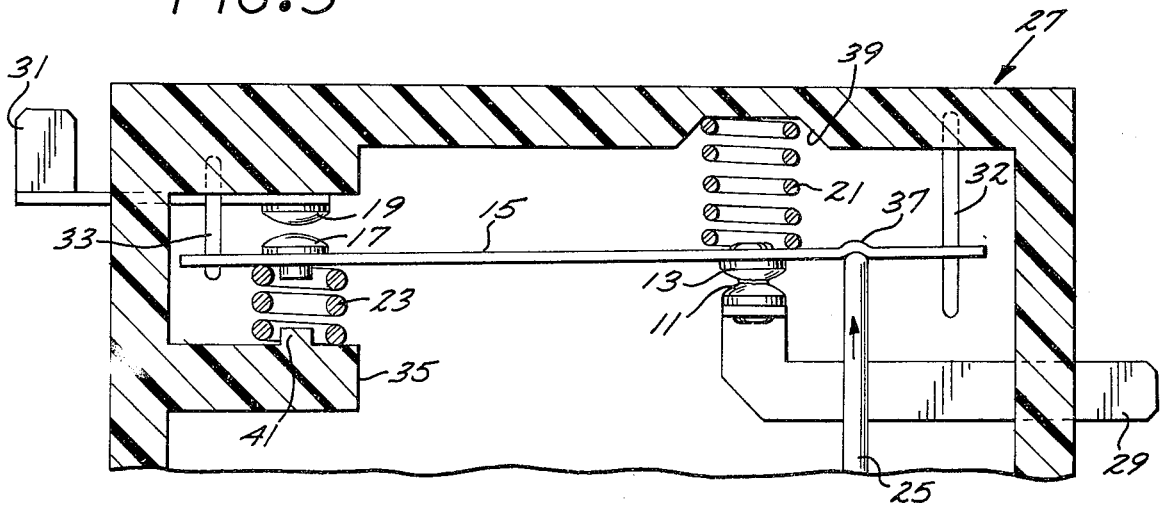
FIG. 3 is a sectional view similar to FIG. 2 but showing the other pair of contacts open.

The dual fulcrum switch of the present invention includes, generally, a first pair of electrical contacts including a stationary contact 11 and a movable contact 13, such movable contact being carried from one end of an electrically conductive relatively rigid blade 15. A second pair of contacts 17 and 19 are provided with the contact 17 being mounted from the end of the blade 15 opposite the contact 13. The blade 15 is biased in clockwise direction by means of a switch biasing spring 21 located over the first pair of contacts 11 and 13 and a safety bias spring 23 located under the second pair of contacts 17 and 19. The blade 15 is formed with an overhang and a solenoid controlled actuator 25 is coupled therewith to raise the right hand end of the blade 15 against the bias of the spring 21 to break the contacts 11 and 13. In instances where the contacts 11 and 13 have become welded together as shown in FIG. 3, the actuator 25 has sufficient force to rotate the blade 15 about the first contact 11 to overcome the bias of the second spring 23 thus breaking the second pair of contacts 17 and 19 to discontinue current flow through the switch even though the first pair of contacts 11 and 13 remain in electrical contact with one another.

The switch is housed in an electrically conductive housing, generally designated 27, having a pair of electrically conductive plug prongs 29 and 31 mounted in the opposite ends thereof, such plug prongs projecting inwardly through the wall of such housing and mounting the respective stationary contacts 11 and 19 in spaced apart relationship. The blade 15 is constructed of a strip of copper approximately 1/16 of an inch (1.6 mm) thick and 3/8 of an inch (9.5 mm) wide to provide relatively stiff construction and low resistance to current flow therethrough. The opposite extremities of the blade 15 project beyond the contacts 11 and 19 to engage respective blade guides 32 and 33 carried from the housing 27.

The overhang of the blade 15 is formed with a downwardly opening dimple 37 into which the end of the actuator 25 is received, such actuator being in the form of a solenoid armature.

The switch spring 21 is in the form of a coil compression spring with the top end thereof being received in a depression 39 in the housing 27 and the bottom end thereof surrounding the back side of the contact 13 and engaging the blade 15.

Projecting interiorally from the left end wall of the housing 27 is a flange 35 having an upwardly projecting tip 41 formed thereon, the bottom end of the safety coil compression spring 23 being received over such tip 41 and the top end thereof pressing upwardly on the underside of the blade 15 directly under the contact 17.

In operation, plug sockets from an electrical device to be controlled may be plugged on the plug prongs 29 and 31 and the solenoid controlling the armature 25 connected with a control circuit which will normally maintain the contacts 11, 13, 17 and 19 in their closed positions. However, when the solenoid (not shown) is actuated to shift the armature 25 upwardly, the force of the solenoid will overcome the bias of the switch spring 21 to raise the movable primary contact 13 away from the stationary primary contact 11 to thereby open the circuit to the controlled device.

It is well known that electrical arcing frequently takes place between electrical contacts during making and breaking thereof, thus resulting in the metal at the surfaces of such contacts being rendered molten and causing them to weld themselves together the next time contact is made. However, should the contacts 11 and 13 become welded together as shown in FIG. 3, upon subsequent actuation of the solenoid controlling the armature 25, the contacts 11 and 13 will resist opening but the solenoid controlled actuator 25 will develop sufficient force to drive the right hand end of the blade 15 upwardly to rotate such blade 15 counterclockwise about the fulcrum contact 11 thus overcoming the force of the back-up spring 23 to rotate the left hand end of the blade 15 downwardly, thus opening the contacts 17 and 19 as shown in FIG. 3 to thereby open the circuit to the device being controlled. Thereafter, when the solenoid controlling the armature 25 is de-energized, such armature will be retracted, thus enabling the safety spring 23 to raise the left hand end of the blade 15 to close the contacts 17 and 19, thus reenergizing the device being controlled. However, upon examination during the next maintenance procedure, welding of the contacts 11 and 13 will be detected thereby alerting the maintenance personnel that the switch should be replaced.

From the foregoing, it will be apparent that the dual fulcrum switch of the present invention provides an economical and convenient means for controlling an electrical device and which provides flexibility with respect to current carrying capacities and also has back-up capabilities for opening the circuit to the control device irrespective to welding together of the primary contacts thereof.

Obviously, many modifications and variations of the present invention may be made with regard to the foregoing detailed description without departing from the spirit of the invention.

What is claimed is:

1. Dual fulcrum switch apparatus comprising:

a housing;

first and second fulcrum contacts mounted from said housing in substantially opposed relationship and spaced apart transversely out of alignment with one another;

an elongated electrically conductive lever blade interposed between said fulcrum contacts and including third and fourth contacts on the opposite extremities thereof and disposed on the opposite sides of said blade for engagement with said respective first and second fulcrum contacts;

biasing means engaged with said blade and urging said third and fourth contacts in opposite directions into engagement with said respective first and second fulcrum contacts; and a switch actuator engaging said lever blade and operable upon actuation thereof to rotate said blade in one direction about said second fulcrum contact to break said first fulcrum and third contacts and further operable when said first fulcrum and third contacts are welded together to rotate said lever arm in said one direction about said third fulcrum contact to break said second fulcrum and fourth contacts.

2. Dual fulcrum switch apparatus as set forth in claim 1 wherein:

said bias means includes first and second coil springs mounted from said housing and engaging said blade adjacent said third and fourth contacts, respectively.

3. Dual fulcrum switch apparatus as set forth in claim 1 that includes:

a pair of blade guides mounted from said housing and disposed at the opposite ends of said blade for guiding movement of said blade.

4. Dual fulcrum switch apparatus as set forth in claim 1 wherein:

said biasing means includes a pair of coil springs mounted on opposite sides of said blade at opposite ends thereof.

5. Dual fulcrum switch apparatus as set forth in claim 1 wherein:

said blade projects beyond said third contact to form an overhang and said actuator engages said overhang and is operative to normally rotate said blade about said second fulcrum contact and upon said first fulcrum and third contacts becoming welded together is operative to rotate said blade about said first fulcrum contact.

6. Dual fulcrum switch apparatus as set forth in claim 3 wherein:

said biasing means includes a pair of coil springs.

* * * * *